United States Patent [19]

Holmes

[11] Patent Number: 4,669,641

[45] Date of Patent: Jun. 2, 1987

[54] TETHERED SWIVEL CAP

[76] Inventor: William A. Holmes, 209 Highland Ave., Piedmont, Calif. 94611

[21] Appl. No.: 770,077

[22] Filed: Aug. 28, 1985

[51] Int. Cl.[4] ..... B65D 55/16

[52] U.S. Cl. ..... 222/543; 24/90 HA; 24/90 TA; 24/301; 215/306; 220/375

[58] Field of Search ..... 222/543; 220/375; 215/306; 24/90 HA, 90 TA, 693, 117, 119, 298–302

[56] References Cited

U.S. PATENT DOCUMENTS

| | | | |
|---|---|---|---|
| Re. 8,034 | 1/1878 | Klee | 215/364 |
| 65,857 | 6/1867 | Alexander | 215/306 X |
| 79,536 | 7/1868 | Alexander | 215/306 X |
| 218,719 | 8/1879 | Doyle | 215/306 X |
| 602,822 | 4/1898 | Boyntony et al. | 215/306 |
| 626,374 | 6/1899 | Fisher | 24/119 |
| 1,052,551 | 2/1913 | Zeller | 24/117 R |
| 1,419,043 | 6/1922 | Gray | 24/299 X |
| 1,611,852 | 12/1926 | Cooper | 220/288 |
| 2,194,940 | 3/1940 | Hiertz | 24/116.1 X |
| 2,263,798 | 11/1941 | Clemens | 215/306 X |
| 2,322,805 | 6/1943 | Johnson | 220/375 X |
| 2,343,678 | 3/1944 | Larkin | 222/543 X |
| 2,468,758 | 5/1949 | Johnson | 220/375 |
| 2,854,789 | 10/1958 | Berry | 220/375 X |
| 3,008,612 | 11/1961 | Ganter | 222/543 |
| 3,636,594 | 1/1972 | Faivre | 24/298 |
| 3,778,871 | 12/1973 | Ratte, Jr. | 24/90 HA X |
| 3,874,570 | 4/1975 | Katzman et al. | 222/543 |
| 4,112,551 | 9/1978 | Sales | 24/117 R |
| 4,432,120 | 2/1984 | Sherman et al. | 222/543 X |

FOREIGN PATENT DOCUMENTS

| | | | |
|---|---|---|---|
| 126798 | 2/1932 | Fed. Rep. of Germany | 24/119 |
| 498610 | 9/1954 | Italy . | |

*Primary Examiner*—Joseph J. Rolla
*Assistant Examiner*—Kevin P. Shaver
*Attorney, Agent, or Firm*—David Pressman

[57] ABSTRACT

A flexible tether arrangement is provided between a fluid container (10) and a cap (12) to permit free swiveling of the cap for enabling it to be screwed onto the container. A tether line (14) has one end (30) attached to the container and the other end (32') attached in a swivelable manner to the cap. The cap has a projecting boss (20) with a relatively small journal hole (28) drilled into its end and a relatively large assembly hole (26) drilled into its side so as to communicate with the assembly hole. The end of the tether line has a stop (32') thereon, made of a ball of fusion, which is positioned at the junction of the two holes. The stop is smaller than the assembly hole so that after it is formed on the free end of the tether when it projects out from the assembly hole, it can be pulled back into the assembly hole. The stop is larger than the journal hole so that after it is so pulled back, it can not be pulled out of the journal hole. The arrangement can be used to join various other associated parts.

12 Claims, 3 Drawing Figures

TETHERED SWIVEL CAP

BACKGROUND

1. Field of Invention

This invention relates to tethered objects which can swivel, particularly to a tethered cap for a fluid container, which cap can swivel or rotate freely.

2. Description of Prior Art

In many applications there is a need to interconnect separate members so that they can swivel freely. The most common application is a liquid container and its cap: the cap should be able to swivel freely so that it can be screwed onto its container, yet should be held by a flexible tether so that it cannot be lost or misplaced. Another application is found in multi-part toys or disconnectable industrial or military assemblies which must be held together by a tether (so that they will not be lost) which should not be twistable (so that it will not tangle or wear).

Heretofore many different arrangements were used to interconnect separate members so that they could swivel freely. The following is a discussion of these arrangements and their drawbacks:

One type involved captivated cords which connected one object, such as a container cap to another, such as a container. Alexander U.S. Pat. No. 79,536, 1868, is examplary. However in these arrangements the cord was fixed in a non-swivelable manner at each of its ends so that the cap could swivel only to a limited extent, in accordance with the flexibility or twistability of the cord. This is undesirable since twisting the cord tended to wear it out prematurely and also caused it to kink and knot. Also it is desirable to have a tether which is infinitely swivelable (i.e., one where the cap can be rotated an infinite number of times) so that the tether can be made shorter and so that the tether does not have to be pretwisted before screwing on the cap. (If a non-swivelable tether is not pretwisted, it will become awkwardly twisted after the cap is screwed on.)

Another arrangement, shown in Klee U.S. Pat. No. 8,034, 1878, comprised a flexible tether which was passed through a horizontal hole in the cap and/or the container and was captivated by an enlarged stop at either or both of its ends. This type of tether was disadvantageous because a cap usually has to be twisted on a vertical axis to be screwed on; thus the horizontal hole(s) did not permit the right type of swiveling. Also the enlarged stop was not held in place and thus tended to extend out from the cap or container where it interfered with usage of the container.

In still another type, shown in Doyle U.S. Pat. No. 281,719, 1879, the cap had awkward top and side holes with tethers. The holes did not communicate and were difficult to use.

Boynton/Fravel U.S. Pat. No. 602,822, 1898, shows a stopper held by captivated rings and beads which were snapped into an elastic matrix. This of course did not permit swiveling and the snap-in beads were not reliable.

Copper U.S. Pat. No. 1,611,852, 1926, and Clemens U.S. Pat. No. 2,263,798, 1941, show beaded wires with the end beads snapped into position. While permitting infinite swiveling, the snap-in captivation of the beads was unreliable and relatively expensive.

Johnson U.S. Pat. Nos. 2,322,805 and 2,468,758, 1943 and 1949 employed a linked or flexible tether with an end stop which was captivated by passing it through a hole in a bar and welding the bar in place. While permitting infinite swiveling, this method was expensive and was not suitable for plastic parts.

Italian Pat. No. 498,610, 1954 and Berry U.S. Pat. No. 2,854,789, 1958, show a cap or other tethered part with a through hole where a flexible tether extended through the hole; the tether had an end stop on the inside of the cap, inside the container, or on the distal side of the tethered part. Since this type of captivation allowed the hole to communicate with the interior of the container, it could not provide a watertight seal. Katzman/Gordon U.S. Pat. No. 3,874,570, 1975, shows a tether with an enlarged end which was inserted into a side, partial circumferential, groove in a cap. This type of tether did not permit infinite swiveling and was unreliable.

Sherman/Francis U.S. Pat. No. 4,432,120, 1984, employed a bead chain or other flexible tether where end stops were captivated in laminated mounting ends which were attached to the cap and contained, respectively. This arrangement was difficult and expensive to fabricate and assemble and was unreliable in operation.

OBJECTS AND ADVANTAGES

Accordingly, several objects and advantages of the invention are to provide a tether arrangement for interconnecting two members in an infinitely swivelable manner. The tether arrangement is economical, reliable, easy to fabricate, and highly durable. Moreover it can be used with plastic or metal parts and does not extend out and will not otherwise interfere with free usage of the interconnected parts. The arrangement will not compromise a watertight seal when it is used to hold a cap for liquid containers. Further objects and advantages will become apparent from a consideration of the ensuing description and accompanying drawings.

DRAWING FIGURES

DRAWING REFERENCE NUMERALS

10 water container
12 cap of 10
14 flexible tether
16 threaded spout
18 base portion of 12
20 top portion of 12
22 interior threads of 12
24 outside ribs of 12
26 horizontal hole of 12
28 vertical hole of 12
30 knot on 14
32 end of 14
32' ball of fusion formed of 32

DETAILED DESCRIPTION

Figure 1:
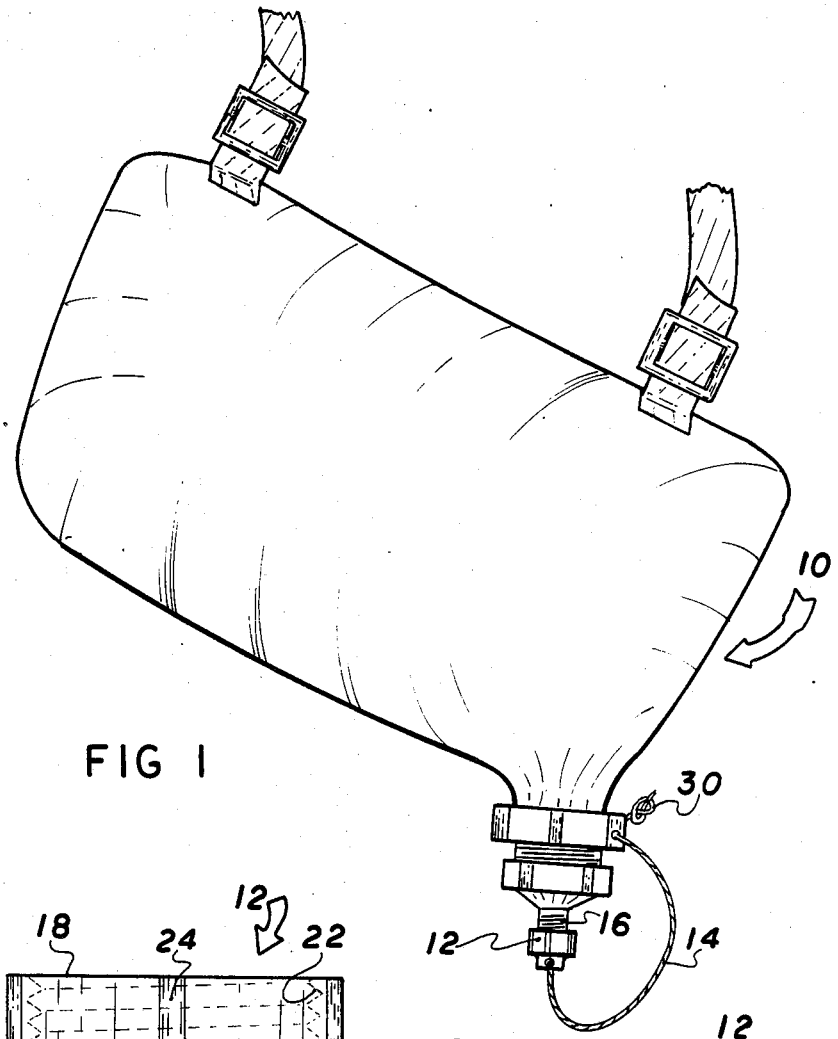
FIG. 1 shows a plan view of a flexible water container with a tethered cap in accordance with the invention.

FIG. 1 shows a plan view of a flexible water container 10 with a screw-on cap 12 (with female threads) held by a flexible tether 14 in accordance with the invention. Container 12 has carrying straps, a replaceable liner (not shown) and related hardware, including a threaded male spout 16 which mates with cap 12.

Figure 2:
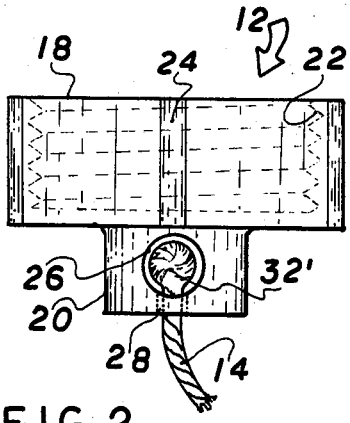
FIG. 2 shows a side view (partially phantom) of the tethered cap.
Figure 3:
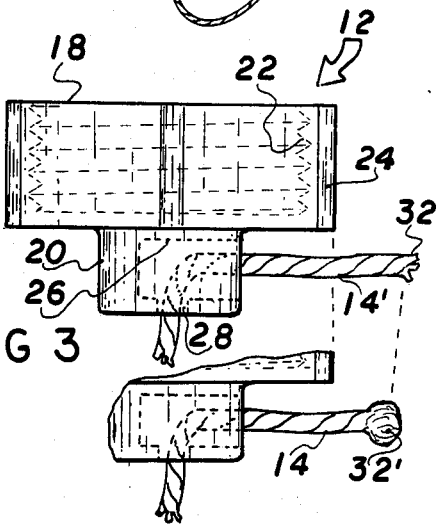
FIG. 3 shows a side view (partially phantom) of the tethered cap taken from another side and showing the formation of the end stop on the tether.

FIG. 2 is an enlarged view of the cap as shown in FIG. 1 and FIG. 3 is an enlarged view of the cap of FIG. 2 from a viewing angle normal to that of FIG. 2. The cap is molded of a plastic, such as nylon or polycarbonate, and has a base portion 18 and a top portion 20 which is integrally joined to base portion 18. Base portion 18 is similar to that of a conventional cap: it has internal (female) threads 22 which mate with the external (male) threads of spout 16 and vertical external ribs 24 for enabling it to be turned easily.

In accordance with the invention, the cap has a top portion 20 which captivates tether 14, yet permits the cap to swivel in an infinite manner on tether 14. Top portion 20 has approximately the same height as base 18, but has a diameter about one-half that of base 18. It is initially formed to be "solid", i.e., voidless and homogeneous. Thereafter a relatively large-diameter horizontal assembly hole 26 is drilled partially through the top, i.e., about $\frac{2}{3}$ across. Then a relatively small-diameter vertical journal hole 28 is drilled from the flat end of the top (the bottom surface as shown in the Figs.) to communicate with assembly hole 26. Alternatively assembly hole 26 can be a through hole, i.e., it can be drilled completely through the top. Also, alternatively, holes 26 and 28 can be formed by the molding process as the top is made.

The approximate dimensions and material of cap 12 in one commercial embodiment were as follows: diameter of base 18: 15.5 mm, diameter of top 20: 8.4 mm, height of base: 9.1 mm, height of top 20: 5.6 mm, diameter of assembly hole 26: 3.2 mm, diameter of journal hole 28: 1.2 mm, spout 16: 12.7 mm OD with #18 threads, material: Celcon ® acetal resin, mfgd. by Celanese, colored black.

Flexible tether 14 preferably is made of a thermosettable material, such as a braided nylon line, 1.1 mm in diameter and 15 cm long before installation. It is installed as follows: The proximal end of the tether is affixed to container 10 in any conventional manner, e.g., by passing it through a hole in a neck ring of the container and knotting the passed-through end, as indicated at 30 in FIG. 1.

The distal end of tether 14 is then inserted into journal hole 28, bent, and pushed out through assembly hole 26, as indicated at 14' in FIG. 3. Then, to captivate the tether, its free end 32 is heated, e.g., by brief application of a flame or a hot tool, e.g., a soldering iron, until end 32 forms an enlarged ball of fusion, as indicated at 32'. Ball 32' is formed to have a dimension which is larger than journal hole 28 and smaller than assembly hole 26 so that it can pass through hole 26, but not through hole 28. In the exemplary case, ball 32' had a diameter of about 2.2 mm.

Then the tether is pulled back to straighten it so that ball 32' will go into assembly hole 26, but will be stopped by journal hole 28, as indicated in FIG. 2. Thereupon ball 32' will be positioned at the junction of holes 26 and 28.

OPERATION

Operation and use of the tether arrangement of the invention is simple and straightforward. When cap 12 is not screwed onto spout 16, it is held by tether 14, yet can rotate freely and infinitely in journal hole 28. This is because, as best seen in FIG. 2, tether 14 forms a pivot pin or swivel and hole 28 forms a mating journal or guideway to enable cap 12 to rotate freely and infinitely, on a vertical axis when seen in FIG. 2. The cap can be screwed freely onto spout 16 as if it were not tethered due to its extreme freedom of rotatability on an axis which can be made coaxial with spout 16. The tether will be firmly and permanently attached to cap 12 since ball 32' cannot be pulled out of relatively narrow journal hole 28. Also ball 32', and hence the tether line, will not readily come back out of assembly hole 26 since it would have to be bent to extend out of hole 26, a relatively difficult operation in the partially-enclosed space where it is positioned.

SUMMARY, RAMIFICATIONS, AND SCOPE

Accordingly it is seen that, according to the invention, a tether arrangement is provided which can interconnect two members in an infinitely swivelable manner, yet in an economical, reliable, easy to fabricate, and highly durable manner. As stated, it can be used with plastic or metal parts, it does not extend out and will not otherwise interfere with free usage of the interconnected parts, and it will not compromise a watertight seal when it is used to hold a cap for liquid containers.

While the above description contains many specificities, these should not be construed as limitations on the scope of the invention, but as exemplifications of the presently-preferred embodiments thereof. Many other ramifications and variations are possible within the teachings of the invention. For example, the tether arrangement can be used to connect any line with a free end to any member and to interconnect military components, toy components, etc. Instead of providing an end stop using a ball of fusion and a plastic tether, a clamped-on ball stop or other mechanical stop can be used. The tether line can thus be made of wire, chain, etc. The assembly and journal holes can have non-round cross-sectional shapes, as can the projecting portion (20) and the base portion (18) itself. Thus the scope of the invention should be determined by the appended claims and their legal equivalents, and not by the examples given.

I claim:

1. A flexible tether arrangement comprising:

a base member, a single flexible tether line, and a tethered member connected to said base member by said flexible tether line, a proximal end of said tether line being attached to said base member, a distal end of said tether line being attached to said tethered member, said tethered member comprising:

a base portion and a projecting portion extending from said base portion, said projecting portion having a side surface and an end surface facing away from said base portion, a journal hole extending into said end surface of said projecting portion, an assembly hole extending into said side surface of said projecting portion, said assembly hole communicating with said journal hole, said assembly hole having a larger cross-sectional dimension than said journal hole, said single tether line extending into said journal hole to the junction of said journal and assembly holes, said base member, said single tether line, and said tether member being free of any restrictive components, such that said tethered member can be freely rotated about the axis of said journal hole an infinite number of times without kinking or twisting or kinking said tether line or any other component, the distal end of said tether line being positioned at the junction of said journal and assembly holes and having a stop thereat which is larger than the cross-sectional dimensional of said journal hole and smaller than the cross-sectional dimension of said assembly hole, such that said end of said tether line with said stop thereat can be pulled through said assembly hole but cannot be pulled through said journal hole, whereby said tethered member can be rotated freely an infinite number of times while still remaining tethered to said base member.

2. The arrangement of claim 1 wherein said tether line is made of a thermosettable material, the distal end of said line being fused to form an enlarged portion which provides said stop thereat.

3. The arrangement of claim 1 wherein said assembly and journal holes extend only partially through said projecting portion.

4. The arrangement of claim 1 wherein said projecting portion of said tethered member has a cylindrical shape with said side surface being curved and said end surface being flat, said assembly hole extending into said curved side surface and said journal hole extending into said flat end surface.

5. The arrangement of claim 1 wherein said base member is a liquid container and said tethered member is a cap for said container, said cap and said container being threadedly mateable.

6. The arrangement of claim 5 wherein said container has a spout thereon which has external threads thereon and wherein said cap has a recess with internal threads therein which mate with the external threads on said spout, said internal threads having an axis which is parallel to the axis of said journal hole, whereby said cap can be screwed onto said spout without restriction or kinking said tether line.

7. The arrangement of claim 1 wherein said assembly and said journal holes are substantially orthogonal.

8. The arrangement of claim 7 wherein said base portion of said tethered member has a cylindrical shape with a greater diameter than said projecting portion.

9. A flexible tether arrangement for use with a container and cap, comprising:

a fluid container, a single flexible tether line, and a cap for said container, a proximal end of said tether line being attached to said container, the distal end of said tether line being attached to said cap, said cap having a sealing portion at one side thereof and a projecting cylindrical portion having a free end at the other side there, said free end having a surface which faces orthogonally away from said sealing portion, a journal hole extending into said end surface of said cylindrical portion, an assembly hole extending into a curved side of said cylindrical portion, said assembly hole communicating with said journal hole, said assembly hole having a larger cross-sectional diameter than said journal hole, said tether line extending into said journal hole to the junction of said journal and assembly holes, said container, said tether line, and said cap being free of any restrictive components, such that said said tethered member can be freely rotated about the axis of said journal hole an infinite number of times without kinking or twisting or kinking said tether line or any other component, the distal end of said tether line being positioned at the junction of said junction and assembly holes and having a stop thereat which is larger than the cross-sectional dimension of said journal hole and smaller than the cross-sectional dimension of said assembly hole, such that said end of said tether line with said stop thereat can be pulled through said assembly hole but cannot be pulled through said journal hole, whereby said tethered member can be rotated freely an infinite number of times but will remain tethered to said base member.

10. The flexible tether arrangement of claim 9 wherein said tether line is formed of a thermosettable material, said stop at the distal end thereof being an enlarged portion formed by fusing the distal end portion of said tether line.

11. The flexible tether arrangement of claim 9 wherein said cap has screw threads thereon which have an axis which is parallel to the axis of said journal hole and wherein said container has a spout with mating threads, whereby said cap can be screwed onto said spout without restriction and without kinking said tether line.

12. The flexible tether arrangement of claim 9 wherein said assembly and said journal holes are orthogonal.

* * * * *